US011839788B2

(12) United States Patent
Jezwinski

(10) Patent No.: US 11,839,788 B2
(45) Date of Patent: Dec. 12, 2023

(54) PORTABLE ANCHOR APPARATUS FOR RESISTANCE EXERCISES

(71) Applicant: Travis Jezwinski, Littleton, CO (US)

(72) Inventor: Travis Jezwinski, Littleton, CO (US)

( * ) Notice: Subject to any disclaimer, the term of this patent is extended or adjusted under 35 U.S.C. 154(b) by 0 days.

(21) Appl. No.: 17/669,613

(22) Filed: Feb. 11, 2022

(65) Prior Publication Data

US 2023/0256284 A1 Aug. 17, 2023

(51) Int. Cl.
*A63B 21/04* (2006.01)
*A63B 21/055* (2006.01)

(52) U.S. Cl.
CPC ..... *A63B 21/0442* (2013.01); *A63B 21/0557* (2013.01); *A63B 2210/50* (2013.01); *A63B 2225/10* (2013.01)

(58) Field of Classification Search
CPC ..... A63B 21/0442; A63B 21/0557; A63B 2210/50; A63B 2225/10
See application file for complete search history.

(56) References Cited

U.S. PATENT DOCUMENTS

| | | | | |
|---|---|---|---|---|
| 10,456,620 | B1 * | 10/2019 | Duenas | A63B 21/0085 |
| 10,532,239 | B1 * | 1/2020 | Suarez Monne | A63B 17/04 |
| 2003/0119635 | A1 * | 6/2003 | Arbuckle | A63B 23/0405 482/142 |
| 2015/0126348 | A1 * | 5/2015 | Kaye | A63B 21/0557 482/130 |
| 2015/0141219 | A1 * | 5/2015 | Bellevue | A63B 21/0442 482/130 |
| 2019/0166993 | A1 * | 6/2019 | Siaperas | A47B 81/00 |
| 2020/0101342 | A1 * | 4/2020 | Lawton | A63B 21/4033 |
| 2021/0228935 | A1 * | 7/2021 | Duplechain | A47B 83/001 |

* cited by examiner

*Primary Examiner* — Andrew S Lo

(57) ABSTRACT

The present disclosure provides a portable anchor apparatus comprised of a modular and foldable frame structure which folds down to a compact shape having a storage compartment with a pair of wheels. The apparatus provides a wide variety of horizontal, vertical, and ground level anchor points and has horizontal bars which can be mounted at different vertical heights to suit a user's needs for various exercises. A kit is also provided herein, the kit comprising the anchor apparatus, a resistance band apparatus, and one or more items capable of being stored within the storage compartment.

12 Claims, 7 Drawing Sheets

PORTABLE ANCHOR APPARATUS FOR RESISTANCE EXERCISES

FIELD OF INVENTION

The present invention relates generally to an anchor system for resistance band exercises. More specifically, the present invention relates to a foldable anchor system design that facilitates efficient switching between resistance band exercises and provides a wide range of horizontal and vertical anchor points on a vertical plane, as well as ground anchor points, for the horizontal plane.

BACKGROUND

The advantages of resistance bands in strength and conditioning training are well known, and their use has grown exponentially in recent years, with many top personal trainers incorporating them heavily into their routines. Bands provide a fantastic combination of portability, flexibility, and exercise efficiency, allowing a user to perform a wide range of motions and exercises by stretching the length of the elastic in the bands away from an anchor point.

Traditionally, bands have comprised a length of elastic with handles on each end. The middle of the band would either be put around an anchor point or stood upon while an exercise is performed with the handles. In order to facilitate a wider variety of different exercises using consistent form, purpose built "anchor systems" were introduced—these are solid framed structures, usually metal, which provide a variety of fixed positions from which an opposite end of a resistance band can be affixed, while the exercise is performed.

While anchor systems greatly improve the variety of resistance exercises that can be performed, they unfortunately do not share the portability and convenience of the resistance bands. They are usually bulky structures that must either be weighted heavily enough to prevent a user from tipping them over during exercise or affixed to a building structure.

In recent years, many attempts have been made to design anchor systems that only need to detachably affix to a building structure, such as door-mounted anchor systems. However, these designs still require significant set-up, the correct type and dimensions of a door frame, and are limited by the dimensions of the structure to which they affix. For example, door mounted systems cannot provide horizontal anchor points which are wider than the width of the door frame, or vertical anchor points higher than its height, thus limiting the variety of exercises which can be performed using them.

Another problem commonly associated with the use of resistance bands and anchor systems is that the process of switching between different mounting points between exercises is time consuming and cumbersome.

Each of the foregoing problems are solved by the anchor system of the present disclosure.

SUMMARY

The present disclosure provides a portable anchor system comprised of a modular and foldable frame structure which folds down to a compact shape having a storage compartment with a pair of wheels. When unfolded for use, the anchor system is shaped such that a user's weight on the platform of the anchor apparatus always provides a counterbalance to forces exerted during exercise, removing the need for added weight or a structure to affix the anchor system to. The standalone apparatus provides a wide variety of horizontal anchor points over 2 horizontal bars with one of the horizontal bars having the ability to be mounted at different vertical heights to suit a user's needs. The storage compartment rests in a horizontal position during the folding process of the system, and it is used for the storage for all the various exercise apparatus used for the anchor apparatus as well as pieces attached to the anchor apparatus when in use. A kit is also provided herein, the kit comprising the anchor system, a resistance band apparatus, and one or more items capable of being stored within the storage compartment.

Thus, according to one aspect of the present disclosure there is provided a portable anchor apparatus for performing resistance exercises, the apparatus comprising: a rectangular base frame having a first planar surface bordered by a pair of hollow open-ended railings, the opposing side of the base frame to the first planar surface forming a storage compartment with a pair of wheels affixed thereto, each railing having a plurality of mounting points distributed along its length; a rectangular floor support having a second planar surface bordered by a second pair of railings, the floor support being foldably coupled to a first end of the of the base frame such that the second planar surface can move between a first position in which it is flush with and parallel to the first planar surface and a second position where it is orthogonal to the first planar surface, each railing of the second pair of railings having a plurality of D-rings distributed along its length; a locking mechanism configured to affix the base frame and floor support in the first or second position.

The apparatus further comprises a pair of detachable railings, each having a plurality of mounting points distributed along its length and having a profile and dimensions such that it can be inserted into a hollow open-ended railing at a second end of the base frame to form a telescopic railing; a first mounting bar having a plurality of resistance band hooks distributed across its length, the first mounting bar being configured to securely attach to the mounting points of the telescopic railings; and a second mounting bar having a plurality of resistance band hooks distributed across its length, the second mounting bar being configured to securely attach to the mounting points of the telescopic railings.

In some embodiments, the storage compartment of the base frame forms a hollow storage space with the first planar surface of the base frame in which exercise accessories and pieces of the anchor apparatus may be stored, when not in use.

In some embodiments, the locking mechanism comprises a pair of bars that interlock with a pair of the mounting points distributed along the first pair of railings. The opposing ends of the locking mechanism bars may be detachably affixed to the second pair of railings using a key-based coupling.

In some embodiments, both the first and second mounting bars are greater in length than the width between the pairs of railings, and have hooks distributed at points in past the outer edges of the railings when affixed to the mounting points such that a user standing on the floor support has access to a wider set of horizontal anchor points for performing resistance exercises.

In some embodiments, each mounting point comprises a protrusion configured to interlock with a mounting hook on one of the mounting bars.

In some embodiments, an opposing end of the base frame to the wheels comprises a carry handle to facilitate wheeling of the apparatus when in a folded state.

According to another aspect of the present disclosure, there is provided a kit comprising a portable anchor apparatus according to any one of the above-described embodiments a resistance band apparatus.

In some embodiments, the elastic tube resistance band apparatus is a novel resistance band apparatus comprising: a handle; a first carabiner coupled to the handle; two or more resistance bands, each resistance band comprising a length of elastic material having a first O-ring disposed at a first end of the length of elastic which is configured to detachably couple to the first carabiner and a second O-ring at the opposing end; a second carabiner coupled to the second O-ring of each resistance band; and a length of nylon webbing having a first D-ring at one end of the length which attaches to the second carabiner and one or more second D-rings disposed along its length to couple to the second O-rings of the resistance bands, each D-ring having a corresponding label; wherein each resistance band is configured with a thickness to provide a set profile of elastic resistance to deformation by stretching which is different from each other resistance band of the apparatus, the thickness and thus level of resistance provided by each resistance band being indicated by a marking and coloration of the band.

In some embodiments, the kit further comprises: a straight modular bar apparatus having detachable end sections such that the dimensions of the straight bar can be reduced to fit within the storage compartment of the anchor apparatus, as well have different sizes while in use to perform various resistance exercises as needed.

In some embodiments, the kit further comprises: a flat bench seat having foldable support legs such that the dimensions of the bench seat can be reduced to fit within the storage compartment of the anchor apparatus.

In some embodiments, the kit further comprises: a pair of suspensions straps comprising a plurality of labelled D-rings distributed across their length; and two or more handle grips.

BRIEF DESCRIPTION OF THE DRAWINGS

Various embodiments of the invention are disclosed in the following detailed description and accompanying drawings.

Figure 1:
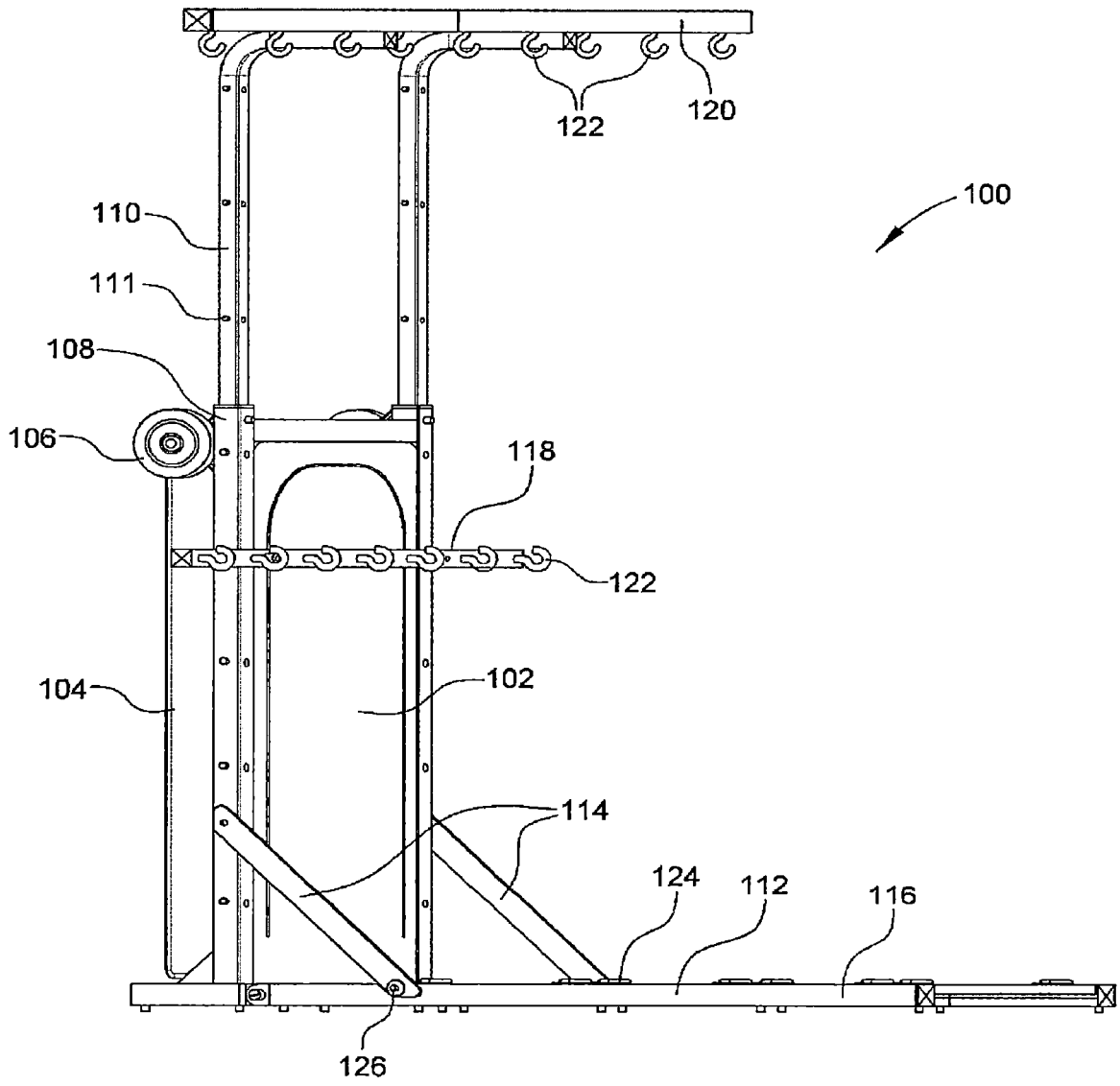
FIG. 1 illustrates a first isometric view of an example anchor system according to the present disclosure in an unfolded position.

Common reference numerals are used throughout the figures and the detailed description to indicate like elements. One skilled in the art will readily recognize that the above figures are examples and that other architectures, modes of operation, orders of operation, and elements/functions can be provided and implemented without departing from the characteristics and features of the invention, as set forth in the claims.

DETAILED DESCRIPTION AND PREFERRED EMBODIMENT

The following is a detailed description of exemplary embodiments to illustrate the principles of the invention. The embodiments are provided to illustrate aspects of the invention, but the invention is not limited to any embodiment. The scope of the invention encompasses numerous alternatives, modifications and equivalent; it is limited only by the claims.

Numerous specific details are set forth in the following description in order to provide a thorough understanding of the invention. However, the invention may be practiced according to the claims without some or all of these specific details. For the purpose of clarity, technical material that is known in the technical fields related to the invention has not been described in detail so that the invention is not unnecessarily obscured.

The terminology used herein is for the purpose of describing particular embodiments only and is not intended to be limiting of the invention. As used herein, the term "and/or" includes any combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

The present disclosure provides a novel design for an anchor apparatus which facilitates easy transportation, fast switching between exercises, and provides a wide horizontal and vertical range of anchor points on a vertical plane, as well as ground anchor points for resistance bands. The anchor apparatus is versatile, lightweight and secure, utilizing the body of a user as the counterweight for the forces they exert during exercises.

Figure 2:
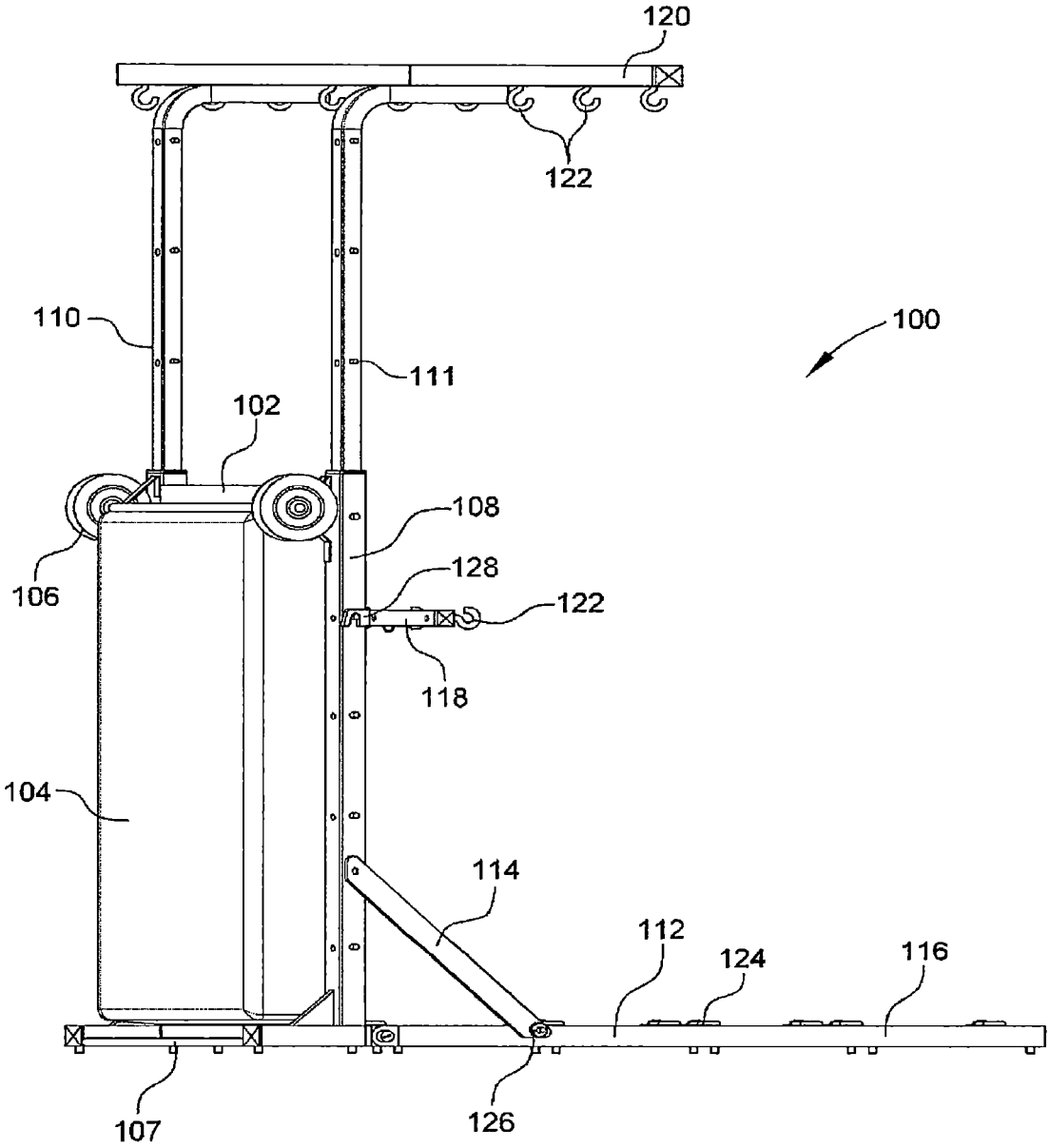
FIG. 2 illustrates a second isometric view of the example anchor system according to the present disclosure in an unfolded position.
Figure 3:
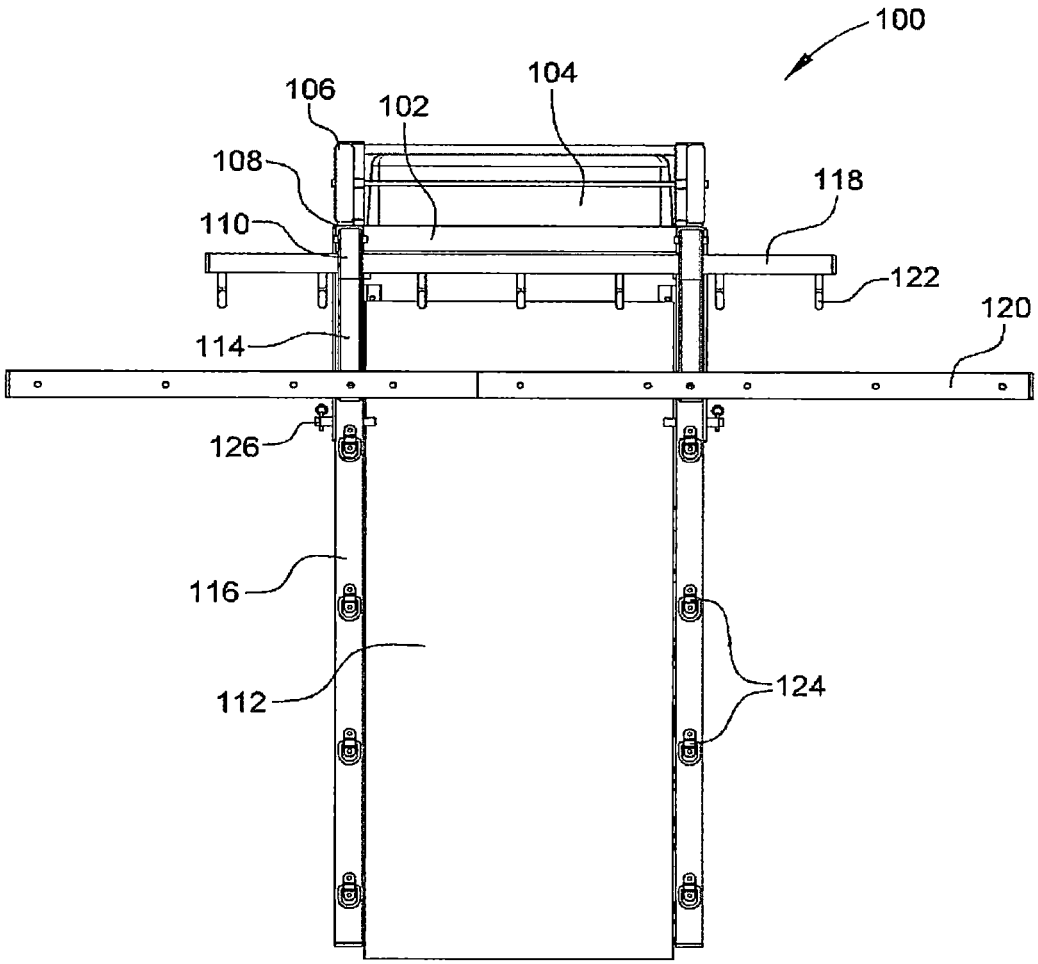
FIG. 3 illustrates a top-down view of the example anchor system according to the present disclosure in an unfolded position.

Referring to FIGS. 1-3, front, back, and top-down views are shown of an example anchor apparatus 100 according to the present disclosure in an unfolded, upright position.

As can be seen, the apparatus comprises a main rectangular base frame 102 with a flat surface bordered by a pair of railings 108. The opposing side of the base frame 102 has a storage compartment 104 with a pair of wheels 106 attached. When the frame is folded down to a more compact state it can be easily lifted, via a bar 107 which is disposed at the opposing end to the wheels and rolled along the ground exactly like a dolly, through standard sized doorways. See FIG. 5.

The base frame 102 and storage compartment 104 from the backbone of the vertical portion of the anchor apparatus when it is in an unfolded state. The storage compartment 104 may also comprise an enclosed hollow space allowing it to double up as a storage space for additional exercise accessories and detached pieces of the anchor apparatus when in a folded and disassembled state.

The railings 108 are hollow and open-ended, allowing a second pair of railings 110 of a detachable top portion to slot inside. Both the first and second pairs of railings have a plurality of mounting points 111 distributed along their length which serve as supports for the horizontal crossbar 118. The variety of different heights at which the crossbar 118 can be affixed along with the width of crossbar 120, allows for significant versatility of anchor points on the vertical plane.

Furthermore, since both crossbars 118 and 120 are detachable and may be stored in the storage compartment when not in use, their width does not limit the openings through which the anchor apparatus can be transported, allowing a much wider range of horizontal anchor points for resistance exercises than is available with other non-permanent anchor systems. The use of hooks 122 as the main mechanism for attaching novel tube style resistance as opposed to O-rings and b-rings, also serves to significantly reduce the time and effort required to switch the bands between different exercises.

Figure 6:
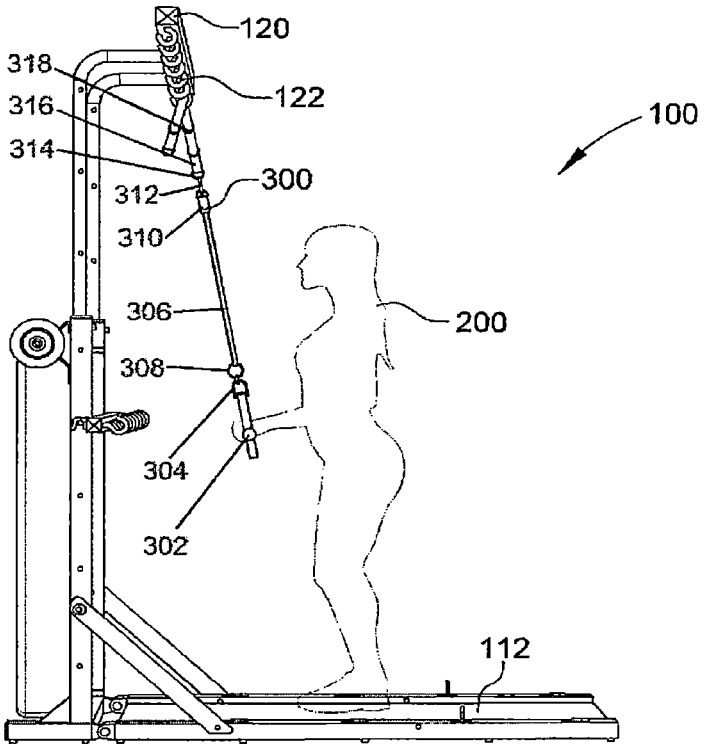
FIG. 6 illustrates the example anchor system and an accompanying elastic tube resistance band apparatus being used by a user in a first exercise.
Figure 7:
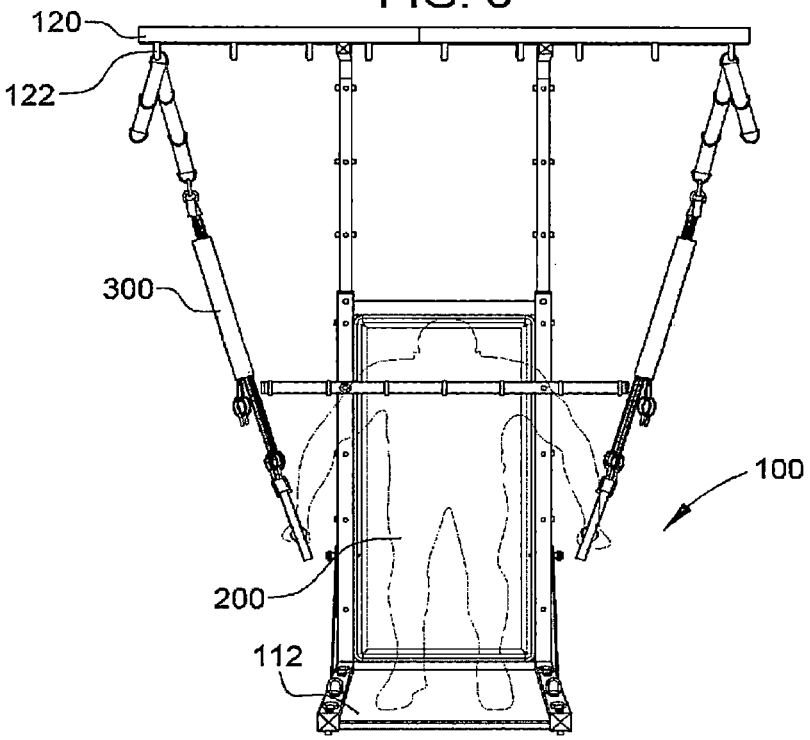
FIG. 7 illustrates the example anchor system and an accompanying elastic tube resistance band apparatus being used by a user in a second exercise.

The distal ends of the second pair of railings 110 are curved approximately 90 degrees so that they, and the top horizontal crossbar 120 mounted atop them which provides a plurality of hook-type anchor points 122, hang over where the user will stand on the apparatus, see FIG. 6 and FIG. 7. This configuration ensures that a user's weight acts to stabilise the apparatus during exercise rather than tipping it, as well as provides the room to do exercises.

The opposing end of the base frame 102 is foldably coupled to a floor support 112 which comprises a flat rectangular surface similar in proportions to that of the base frame and which is also bordered by a pair of railings 116. During use, a user will stand or sit on the surface of the floor support 112, which also helps prevent their movements from unbalancing the apparatus. The floor support 112 is coupled to the base frame 102 by a locking mechanism 114 that holds the two surfaces at a 90-degree angle to one another when locked, but allows the floor support 112 to fold in towards the base frame such that the two surfaces are flush and parallel with one another when unlocked, allowing a significant decrease in the volume taken up by the apparatus.

The railings 116 of the floor support have a plurality of D-rings 124 distributed along their length for exercises which require a user to push or pull up away from the floor. See for example FIG. 8. The D-rings 124 are preferable to hooks as anchor points from the floor support 112 as otherwise gravity would generally cause resistance bands to become unhooked any time the user let the elastic go slack. The resistance bands are attached to these D-rings via a carabiner during the exercise.

In the present example, the locking mechanism 114 between the floor support and the base frame 102 is provided by a pair of solid bars which are affixed by a rotatable joint to opposing mounting points 111 of the base frame, and which can be detachably affixed to the sides of the floor support railings 116 by a key and lock mechanism 126. Of course, other types of locking mechanism may be suitable for achieving the same function and are envisaged as variations of the present disclosure.

Figure 4:
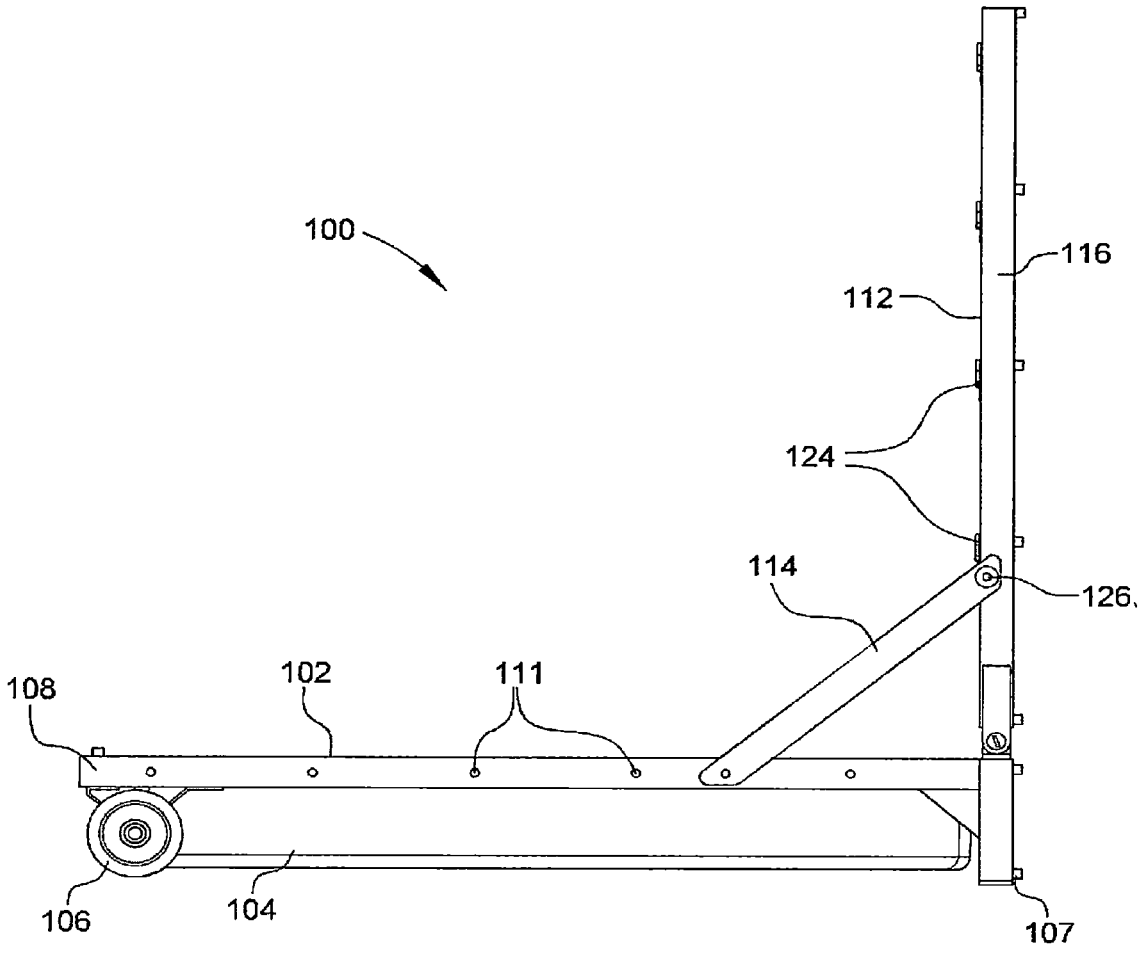
FIG. 4 illustrates a side view of the example anchor system according to the present disclosure on its side prior to folding.
Figure 5:
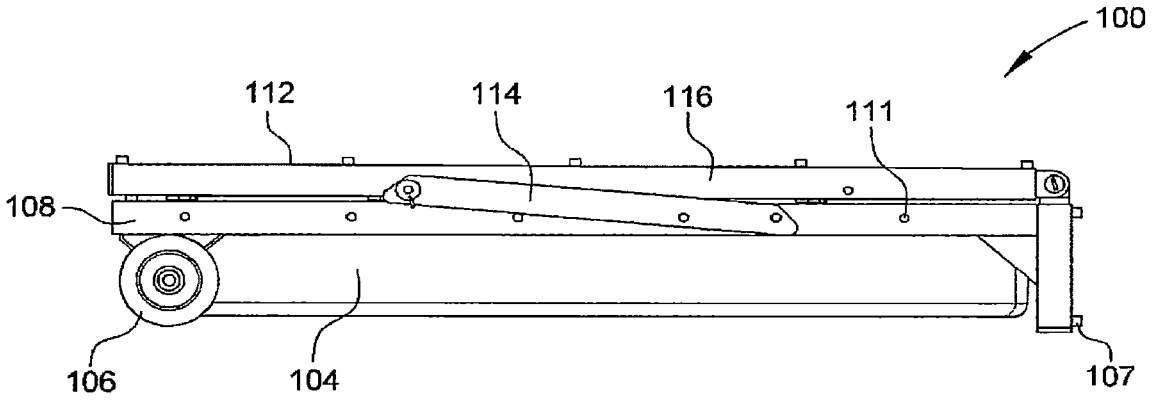
FIG. 5 illustrates a side view of the example anchor system according to the present disclosure on its side in a folded position.

Referring to FIG. 4 and FIG. 5, side views of the example anchor apparatus 100 are shown with the telescopic railings disassembled and the top parts and crossbars removed and are put In the storage compartment to prepare the apparatus for stowing away or transporting.

As can be seen, with these components removed (and optionally, stored within the space provided by the storage compartment 104) the apparatus 100 can easily be shifted onto its side with the wheels 106 on the ground, the locking mechanism 126 unlatched, and the floor support 112 folded down to be flush with the surface of the base frame 102.

Referring to FIGS. 6-10, the same example configuration of the anchor apparatus is shown in use in combination with various exercise equipment for performing different resistance and bodyweight exercises. These are a very small sample of exercises.

Each of the illustrated equipment pieces are designed such that they may be folded or disassembled down to a size that can be stored within the storage compartment 104 for convenience, portability and transportability. Another aspect of the present disclosure thus relates to a kit including the anchor apparatus 100 itself and one or more of said exercise equipment pieces.

Referring to FIG. 6, a user 200 is shown standing and bent over on the floor support 112 and pulling on a handle of a novel resistance band equipment 300 that has been anchored to one of the hooks 122 of the top crossbar 120.

The resistance band equipment is of a novel design that facilitates quick and easily trackable changes between levels of resistance and combines excellently with the versatile anchor apparatus of the present disclosure to overcome the problems of slow and cumbersome changing of anchor positioning between exercises traditionally associated with resistance band training.

The novel elastic tube resistance band apparatus is described in more detail in the applicant's co-pending application, but in summary it comprises: a handle 302; a first carabiner 304 coupled to the handle; two or more resistance bands 306, each resistance band comprising a length of elastic material having a first O-ring 308 disposed at a first end of the length of elastic which is configured to detachably couple to the first carabiner and a second O-ring 310 at the opposing end; a second carabiner 312 coupled to the second O-ring of each resistance band; and a length of webbing 314 having a first D-ring 316 at one end of the length which attaches to the second carabiner and one or more second D-rings 318 disposed along its length to couple to the second O-rings of the resistance bands, each D-ring having a corresponding label; wherein each resistance band is configured with a thickness to provide a set profile of elastic resistance to deformation by stretching which is different from each other resistance band of the apparatus, the thickness and thus level of resistance provided by each resistance band being indicated by a marking or coloration of the band.

Referring to FIG. 7, a user 200 is performing a bent over chest fly exercise with the focus on targeting their lower and mid chest with two such resistance band apparatus 300 anchored to either end of the top horizontal crossbar 120.

Figure 8:
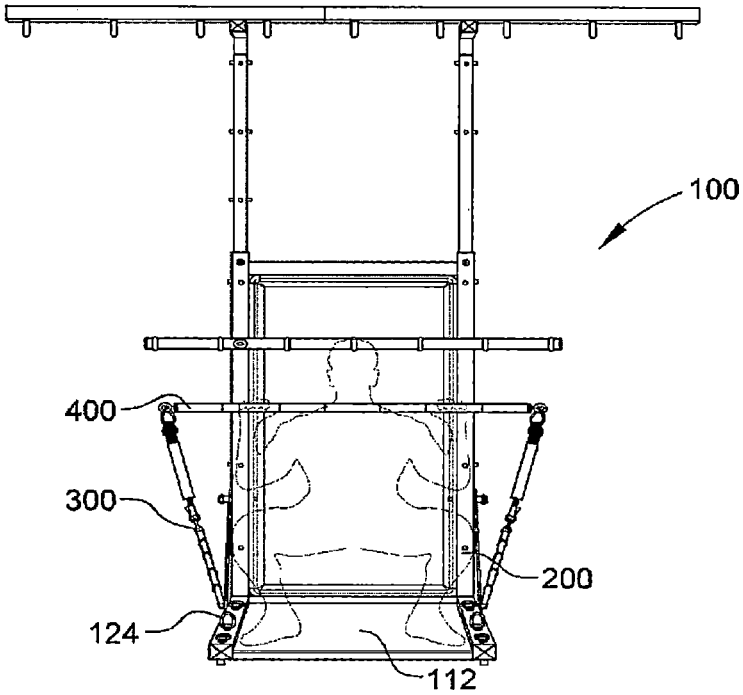
FIG. 8 illustrates the example anchor system, an accompanying elastic tube resistance band apparatus, and a modular bar apparatus being used by a user in a third exercise.

Referring to FIG. 8, a user 200 is shown performing a squat exercise with a straight modular bar apparatus 400 In combination with a pair of the aforementioned resistance band apparatuses. The modular bar 400 comprises a central portion that has a screw-on connection with each of two opposing end portions, allowing the total length of the bar to be reduced down, to use for exercises where a smaller bar is needed using the two end sections, and also for easy storage within the storage compartment 104. The two resistance band apparatuses 300 are coupled to the D-rings 124 on either railing 116 of the floor support 112 via carabiners and the D rings on the nylon strap.

Figure 9:
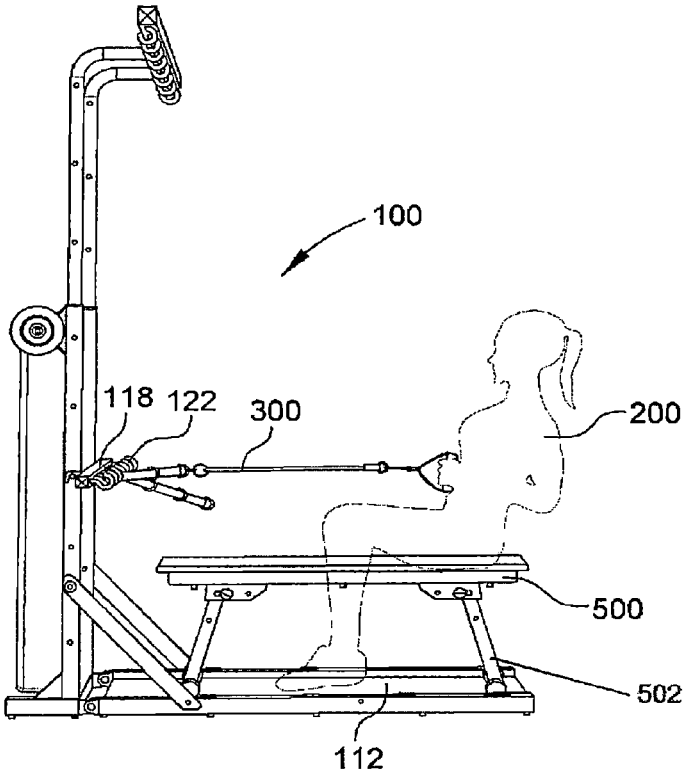
FIG. 9 illustrates the example anchor system, an accompanying elastic tube resistance band apparatus, and a foldable bench apparatus being used by a user in a fourth exercise.

Referring to FIG. 9, a user 200 is shown performing a sitting rowing type exercise on the anchor apparatus 100 and a foldable bench equipment 500 resting on the floor support 112 with a pair of resistance band apparatuses 300 coupled to the hooks 122 of the lower horizontal crossbar 118. The bench equipment 500 is configured with folding legs 502 that can be locked in an extended or folded position to facilitate storage within the storage compartment 104.

Figure 10:
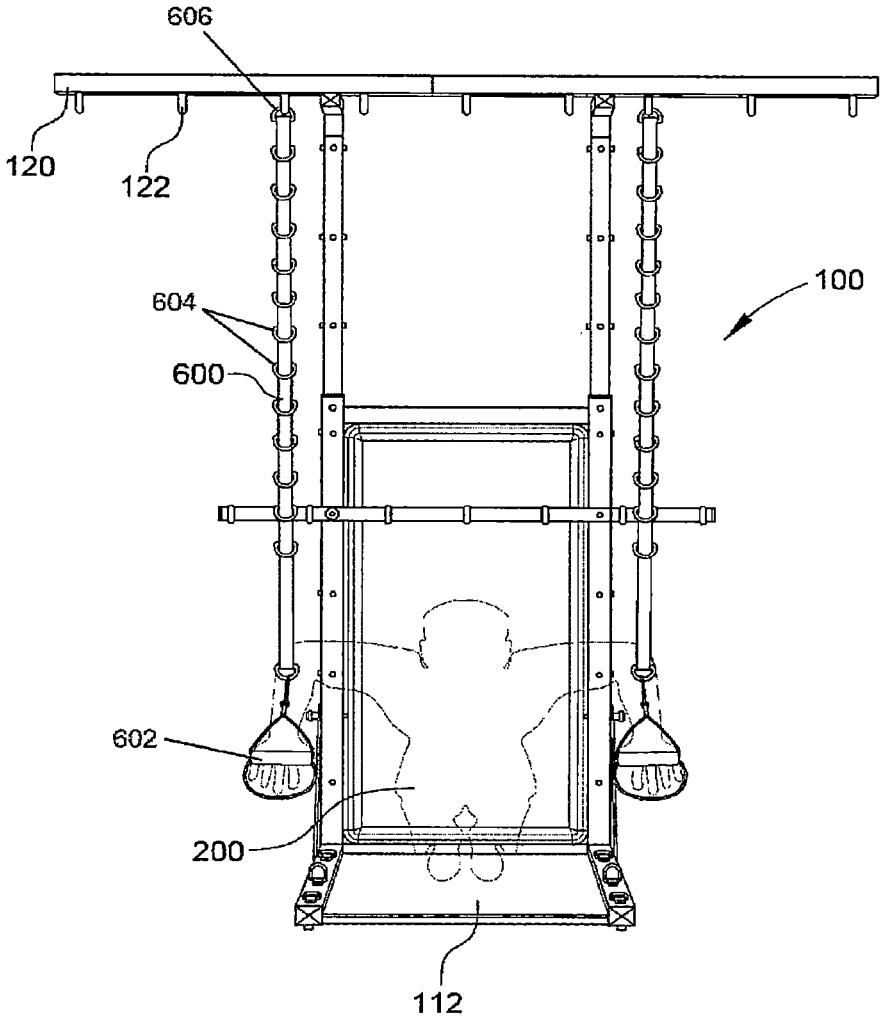
FIG. 10 illustrates the example anchor system and an accompanying suspension strap apparatus being used in a fifth exercise.

Referring to FIG. 10, a user 200 is shown performing a bodyweight, or suspension strap exercise, suspension band pushups, with a pair of novel suspension straps 600 having a handle 602 affixed at one end, a plurality of labelled D-rings 604 distributed along their length, and the D-rings at the opposing ends 606 being anchored to the hooks 122 of the top horizontal crossbar 120 of the anchor apparatus.

Each one of the above-described equipment, and any combination thereof, may form a part of a kit provided by the present disclosure in combination with the disclosed anchor apparatus.

Unless otherwise defined, all terms (including technical terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

The disclosed embodiments are illustrative, not restrictive. While specific configurations of the anchor apparatus have been described in a specific manner referring to the illustrated embodiments, it is understood that the present invention can be applied to a wide variety of solutions which fit within the scope and spirit of the claims. There are many alternative ways of implementing the invention for many exercises, using the novel elastic tube resistance band apparatus, the novel suspension straps, the portable bench, and the straight modular bar apparatus.

It is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A portable anchor apparatus for performing resistance exercises, the apparatus comprising:

a rectangular base frame having a first planar surface bordered by a pair of hollow open-ended railings, an opposite side of the base frame to the first planar surface forming a storage compartment with a pair of wheels affixed thereto, each hollow open-ended railing having a plurality of mounting points distributed along its length;

a rectangular floor support having a second planar surface bordered by a second pair of railings, the floor support being foldably coupled to a first end of the of the base frame such that the second planar surface can move between a first position in which it is flush with and parallel to the first planar surface and a second position where it is orthogonal to the first planar surface, each railing of the second pair of railings having a plurality of D-rings distributed along its length;

a locking mechanism configured to affix the base frame and floor support in the first or second position;

a pair of detachable railings, each having a plurality of mounting points distributed along its length and having a profile and dimensions such that it can be inserted into a hollow open-ended railing at a second end of the base frame to form a telescopic railing;

a first mounting bar having a plurality of resistance band hooks distributed across its length, the first mounting bar being configured to securely attach to the mounting points of the telescopic railings; and a second mounting bar having a plurality of resistance band hooks distributed across its length, the second mounting bar being configured to securely attach to the mounting points of the telescopic railings.

2. A portable anchor apparatus according to claim 1, wherein the storage compartment of the base frame forms a hollow storage space with the first planar surface of the base frame in which exercise accessories and portable anchor apparatus pieces may be stored.

3. A portable anchor apparatus according to claim 1, wherein the locking mechanism comprises a pair of bars that interlock with a pair of the mounting points distributed along the pair of hollow open-ended railings.

4. A portable anchor apparatus according to claim 3, wherein an opposite end of the locking mechanism pair of bars are detachably affixed to the second pair of railings using a key-based coupling.

5. A portable anchor apparatus according to claim 1, wherein both the first and second mounting bars are greater in length than the width between both the pair of hollow open-ended railings and the width between the second pair of railings, and have hooks distributed at points in past the outer edges of the railings when affixed to the mounting points such that a user standing on the floor support has access to a wider set of horizontal anchor points for performing resistance exercises.

6. A portable anchor apparatus according to claim 1, wherein each mounting point comprises a protrusion configured to interlock with a mounting hook on one of the mounting bars.

7. A portable anchor apparatus according to claim 1, wherein an opposing end of the base frame to the wheels comprises a carry handle to facilitate wheeling of the apparatus when in a folded state.

8. A kit comprising a portable anchor apparatus according to arty one of claims 1 to 7 and an elastic tube resistance band apparatus.

9. A kit according to claim 8, wherein the resistance band apparatus is an elastic tube resistance band apparatus comprising: a handle; a first carabiner coupled to the handle; two or more resistance bands, each resistance band comprising a length of elastic material having a first O-ring disposed at a first end of the length of elastic material which is configured to detachably couple to the first carabiner and a second O-ring at a second end of the length of elastic material; a second carabiner coupled to the second O-ring of each resistance band; and a length of webbing having a first D-ring at one end of the length of webbing which attaches to the second carabiner and one or more second D-rings disposed along the length of webbing to couple to the second O-rings of the resistance bands, each D-ring having a corresponding label; wherein each resistance band is configured with a thickness to provide a set profile of elastic resistance to deformation by stretching which is different from each other resistance band of the apparatus, the thickness and thus level of resistance provided by each resistance band being indicated by a marking and coloration of the band.

10. A kit according to claim 8, wherein the kit further comprises: a straight modular bar apparatus having detachable end sections such that the dimensions of the straight modular bar apparatus can be reduced to fit within the storage compartment of the anchor apparatus.

11. A kit according to claim 8, wherein the kit further comprises: a flat bench having foldable support legs such that the bench seat can be reduced to-fit within the storage compartment of the anchor apparatus.

12. A kit according to claim 8, wherein the kit further comprises: a pair of suspensions straps comprising a plurality of labelled D-rings distributed across their length; and two or more handle grips.

* * * * *